US012013149B2

(12) United States Patent
Shrestha et al.

(10) Patent No.: US 12,013,149 B2
(45) Date of Patent: Jun. 18, 2024

(54) THERMALLY ANISOTROPIC COMPOSITES FOR THERMAL MANAGEMENT IN BUILDING ENVIRONMENTS

(71) Applicant: UT-Battelle, LLC, Oak Ridge, TN (US)

(72) Inventors: Som S. Shrestha, Oak Ridge, TN (US); Kaushik Biswas, Davis, CA (US); Diana Hun, Oak Ridge, TN (US); Jerald A. Atchley, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 635 days.

(21) Appl. No.: 16/849,070

(22) Filed: Apr. 15, 2020

(65) Prior Publication Data

US 2020/0326085 A1 Oct. 15, 2020

Related U.S. Application Data

(60) Provisional application No. 62/833,842, filed on Apr. 15, 2019.

(51) Int. Cl.

| | |
|---|---|
| ***E04B 1/76*** | (2006.01) |
| ***E04B 1/62*** | (2006.01) |
| ***E04C 2/52*** | (2006.01) |
| ***F24F 5/00*** | (2006.01) |

(52) U.S. Cl.

CPC ..... *F24F 5/0089* (2013.01); *E04B 1/62* (2013.01); *E04B 1/762* (2013.01); *E04C 2/525* (2013.01)

(58) Field of Classification Search

CPC ..... E04C 2/525; F24F 5/0089
USPC ..... 52/220.1
See application file for complete search history.

(56) References Cited

U.S. PATENT DOCUMENTS 3,982,876 A * 9/1976 Eisenbach ..... E04F 13/0862 425/371
4,730,953 A * 3/1988 Tarko ..... E02B 11/00 405/50
4,923,331 A * 5/1990 Kreikemeier ..... E02B 11/00 405/36

(Continued)

*Primary Examiner* — James J Buckle, Jr.
(74) *Attorney, Agent, or Firm* — WARNER NORCROSS + JUDD LLP

(57) ABSTRACT

An improved system for thermal management is provided. The system includes thermally anisotropic composites coupled with a thermal loop to re-direct, reduce, and shape heat flows through a building envelope, having the potential to (1) significantly reduce envelope-generated heating and cooling loads and (2) provide grid services such as decreasing peak loads and shaping energy use. In one embodiment, the thermal management system includes an anisotropic composite that consists of alternating layers of thermal insulation and thermally conductive materials that are immediately adjacent to each other, including polyisocyanurate foam boards and aluminum sheets. The thermal management system also includes a thermal loop along the long edge or the entire the perimeter of the anisotropic composite, the thermal loop having dynamically controlled or floating temperature that is maintained at lower than an outdoor ambient temperature (for cooling). An interior wall structure is inwardly adjacent to the anisotropic composite.

13 Claims, 10 Drawing Sheets
(3 of 10 Drawing Sheet(s) Filed in Color)

(56) References Cited

U.S. PATENT DOCUMENTS 5,056,281 A * 10/1991 McCarthy ..... E04B 1/0007 52/169.5
5,220,760 A * 6/1993 Dimakis ..... E04C 2/296 428/536
5,292,065 A * 3/1994 Fiedrich ..... F24D 3/14 165/56
5,410,852 A * 5/1995 Edgar ..... E04B 1/762 52/515
5,713,696 A * 2/1998 Horvath ..... E02B 11/00 405/36
5,931,381 A * 8/1999 Fiedrich ..... F24F 13/222 165/49
5,979,131 A * 11/1999 Remmele ..... E04B 1/762 52/302.3
6,182,903 B1 * 2/2001 Fiedrich ..... F24D 3/16 237/69
6,270,016 B1 * 8/2001 Fiedrich ..... F24D 3/142 165/56
8,288,689 B1 * 10/2012 Adelman ..... H05B 3/34 219/241
8,752,346 B1 * 6/2014 Shaw ..... F24D 3/127 165/56
9,146,038 B2 * 9/2015 Cha ..... E04B 5/48
9,562,359 B1 * 2/2017 Grisolia ..... B32B 3/266
9,758,944 B2 * 9/2017 Parks ..... E02D 31/025
10,697,174 B1 * 6/2020 Bomberg ..... B32B 5/26
2011/0197528 A1 * 8/2011 Egan ..... E04B 1/644 52/309.3
2012/0267067 A1 * 10/2012 Sullivan ..... B29C 44/445 428/167
2014/0069605 A1 * 3/2014 Sullivan ..... B21D 47/00 165/56
2015/0047807 A1 * 2/2015 Fiedrich ..... F24D 19/1009 165/56
2016/0017603 A1 * 1/2016 Cha ..... F24D 3/127 52/220.1
2018/0236754 A1 * 8/2018 Schillings ..... B32B 5/028
2021/0340764 A1 * 11/2021 Düwel ..... H05B 3/16

* cited by examiner

| Case | Total annual heat gain (Wh/m²) | Percent difference |
|---|---|---|
| 2" PIR (baseline) | 16780 | N/A |
| 2" PIR-AI | 5266 | -69% |

| Test Parameter | | Base | Base + XPS | Base + TAC |
|---|---|---|---|---|
| Summer | Cooling load (Wh) | 5310 | 3021 | 770 |
| | % difference | - | -43.1% | -85.5% |
| Winter | Heating load (Wh) | 4781 | 2629 | 1760 |
| | % difference | - | -45.0% | -63.2% |

FIG. 10

THERMALLY ANISOTROPIC COMPOSITES FOR THERMAL MANAGEMENT IN BUILDING ENVIRONMENTS

CROSS-REFERENCE TO RELATED APPLICATIONS

This application claims the benefit of U.S. Provisional Application 62/833,842, filed Apr. 15, 2019, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to the thermal management of building envelopes using thermally anisotropic composites that are connected to a thermal loop that serves as a heat sink or source.

BACKGROUND OF THE INVENTION

In buildings, thermal management is important for both energy consideration and thermal comfort. Thermal management to limit heat transfer through the building envelope (walls, roof, and foundation) has traditionally been performed with insulation materials. Alternative methods have been proposed, including an emphasis on thermal mass, solar control and shading, and ventilation. Vacuum insulation panels and aerogels are among a new generation of high-performance insulation materials being investigated. These materials can provide higher thermal resistance compared to current foam and fibrous insulation materials, but suffer from high cost, low durability, and diminishing savings. Accordingly, there remains a continued need for new thermal management systems for building envelopes, and in particular, thermal management systems that can be dynamically controlled to reduce peak energy demand, shape energy use, and redirect heat for thermal energy harvesting or thermal storage in existing and new buildings. Previously proposed dynamic systems primarily focus on controlling the heat transfer rate through the envelope by changing their thermal resistance, but are not able to redirect heat.

SUMMARY OF THE INVENTION

An improved system for thermal management is provided. The system includes thermally anisotropic composites coupled with a thermal loop to dynamically redirect, reduce, and/or shape heat flows through a building envelope, having the potential to (1) significantly reduce envelope-generated heating and cooling loads in buildings and (2) provide grid services such as decreasing peak loads and shaping energy use.

In one embodiment, the thermal management system includes an anisotropic composite that is made of alternating layer(s) of thermal insulation material and thin layer(s) of thermally conductive material. The thermal management system also includes a thermal loop that serves as heat sink or source along a long edge or the entire perimeter of the anisotropic composite. The temperature of the fluid circulating in the thermal loop (referred to as fluid hereafter) is either dynamically controlled or is let to float. During cooling periods, the fluid in the thermal loop is maintained at a temperature that is lower than that of the outdoor ambient temperature. When the outdoor ambient temperature reaches a building balance point temperature (the building balance point temperature is the outdoor air temperature when the heat gains of the building are equal to the heat losses), for example, 12.78° C. (55° F.), the thermal loop can stop circulating a cooling fluid (i.e., temperature of the fluid is lower than outdoor air temperature) and optionally switches to circulating a heating fluid (i.e., temperature of the fluid is greater than outdoor air temperature).

In another embodiment, the thermal management system operates as part of the ceiling, roof, or ground floor to dynamically redirect, reduce, and/or shape heat transfer through the building envelope. The thin layer(s) of thermally conductive material includes a thickness of between 5 microns and 500 microns, inclusive, further optionally about 100 microns, and the polyisocyanurate foam or any insulation board includes a thickness of between 0.25 inches and 7 inches, inclusive, further optionally 0.5 inches. The thermal loop can include a pipe (e.g., copper, crosslinked polyethylene (PEX)) for circulating a fluid at a dynamically controlled or floating temperature. The thermal loop can switch between a heat sink mode and a heat source mode depending on the outdoor ambient temperature and can turn off circulation at other times. As set forth below, finite element heat transfer simulations and large-scale laboratory experiments of the thermal management system of the present invention demonstrated the feasibility of greater than 20% reductions in envelope-related cooling energy with a negligible increase in wall thickness when compared to a wall with exterior continuous insulation. The embodiments of the present invention are well suited for both new constructions and existing constructions across a variety of climates to (1) significantly reduce envelope-generated heating and cooling loads and (2) provide grid services such as decreasing peak loads and shaping energy use.

Energy from the thermal loop can be harvested and used for domestic hot water systems, heat pump systems, thermoelectric cloth dryers, or any appliances and equipment that needs thermal energy. Energy from the thermal loop can also be harvested and stored in thermal energy storage systems that use phase-change materials, chemical energy storage, or other thermal energy storage systems to use the thermal energy at later time. If no device is available to utilize the harvested thermal energy, it can be discarded in the ground or outdoor air. To operate the thermal loop as heat source, waist heat from appliances, equipment, and/or ground can be utilized.

These and other features and advantages of the present invention will become apparent from the following description of the invention, when viewed in accordance with the accompanying drawings and appended claims.

BRIEF DESCRIPTION OF THE DRAWINGS

This patent or application file contains at least one drawing executed in color. Copies of this patent or patent application with color drawing(s) will be provided by the Office upon request and payment of the necessary fee.

FIG. 10 includes a table illustrating a comparison of integrated cooling and heating loads for the 2.44 m×2.44 m central measurement area of the test specimen of FIG. 8.

DETAILED DESCRIPTION OF THE CURRENT EMBODIMENTS

Figure 1:
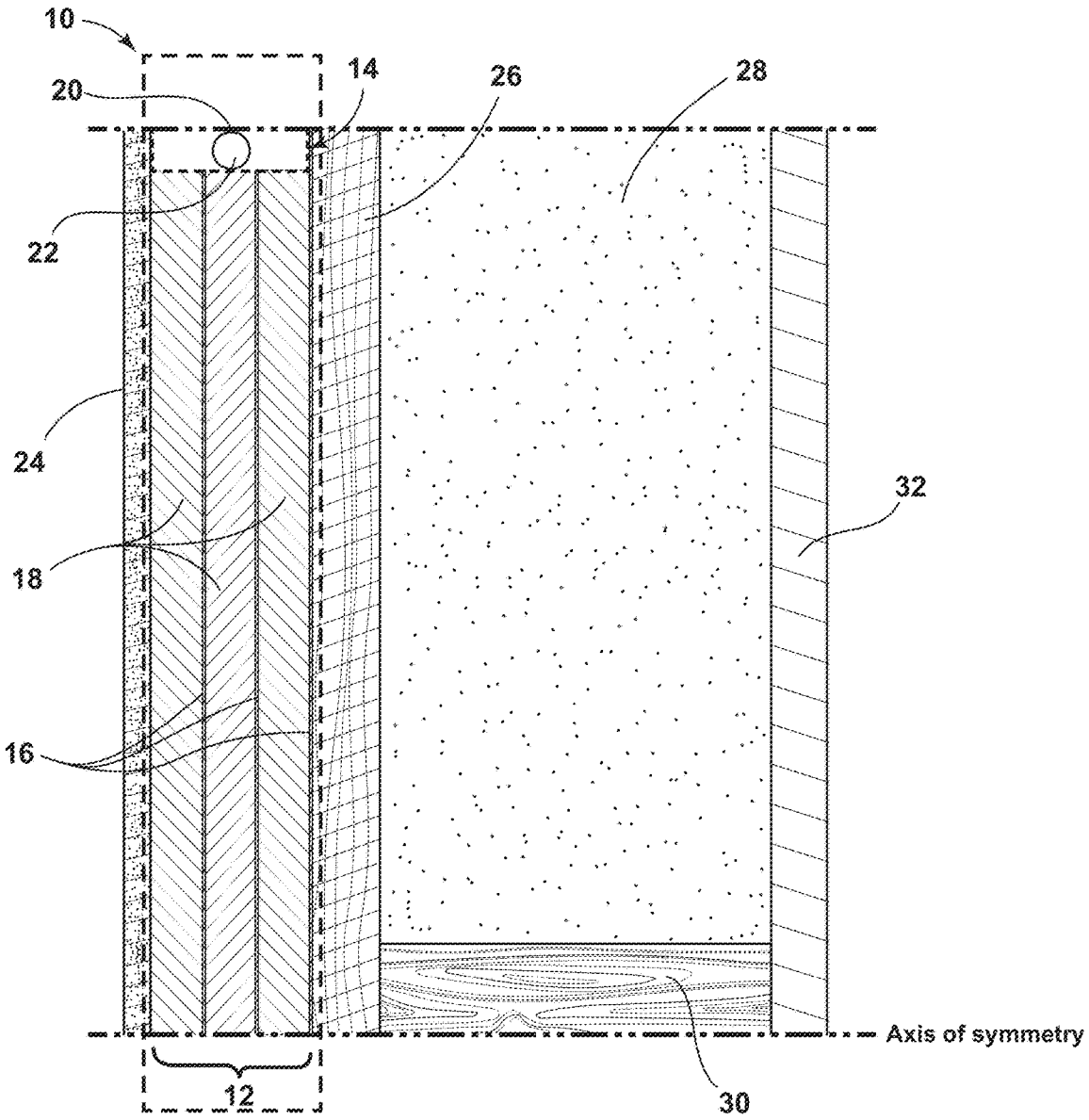
FIG. 1 is a top cross-sectional view a thermal management system in accordance with an embodiment of the present invention.

Referring to FIG. 1, a thermal management system for a building envelope component is illustrated and generally designated 10. Though illustrated as a wall component, the thermal management system 10 is also suitable for use as a roof component and as a ground floor component. The thermal management system 10 generally includes an anisotropic composite 12 and a thermal loop 14 in thermal communication with the anisotropic composite 12 to redirect, reduce, and shape heat flows through a building envelope. Each such feature of the thermal management system 10 is discussed below.

The thermal management system 10 includes an anisotropic composite 12. As used herein, an "anisotropic composite" means a composite whose thermal conductivity is anisotropic, such that its in-plane thermal conductivity differs from its through-plane thermal conductivity. In the illustrated embodiment, the thermal conductivity (W/(m·K)) of the anisotropic composite 12 is greater in-plane than through-plane. To achieve this anisotropic thermal conductivity, the composite 12 is composed of alternating layers of a thermally conductive material 16 and an insulating material 18. The conductive material 16 is placed on the insulating material 18, being aluminum in the present embodiment, optionally with a thickness of between 5 microns and 500 microns, inclusive, further optionally 100 microns. The conductive material 16 can include other materials in other embodiments, for example copper foil. The insulating material 18 includes a polyisocyanurate foam board in the current embodiment. In other embodiments, the insulating material 18 includes rigid extruded polystyrene (XPS) or other foam insulation, for example extruded polystyrene foam, while in still other embodiments the insulating core material 18 can include fibrous insulation materials, for example polyester fibers or glass fibers. The composite 12 includes insulation boards a thickness of between 0.25 inches and 7 inches, inclusive, further optionally 0.5 inches.

Figure 8:
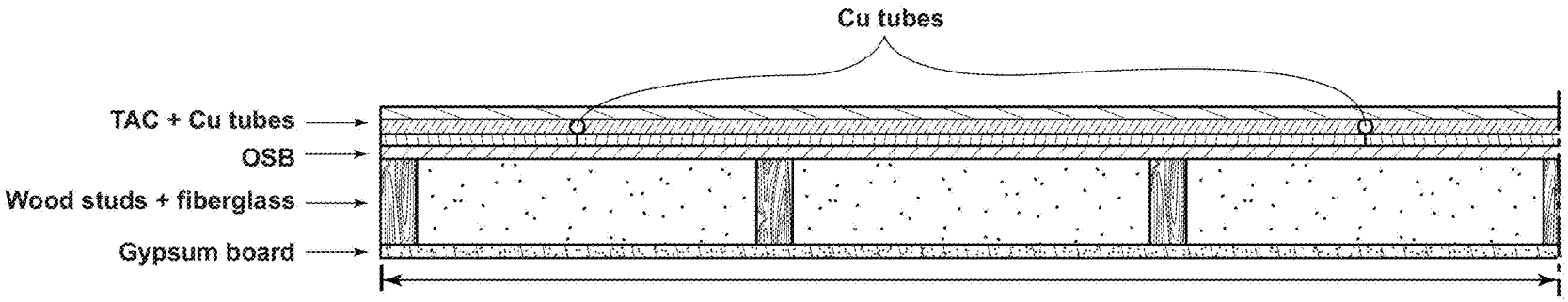
FIG. 8 is a top cross-sectional view of a thermal management system of the present invention that evaluated against conventional insulation materials in a large-scale environmental chamber.

Each anisotropic composite 12 is composed of alternating layers of an insulating material 18 and a thermally conductive material 16, which, during the cooling season, draws heat in-plane toward the thermal loop 14 and decreases the through-plane (inward) heat transfer to the building interior. The thermal management system 10 includes an anisotropic composite with three alternating layers of conductive and insulating materials 12 that are in contact with each other in the present embodiment. The anisotropic composite can be made of greater or fewer alternating layers of conductive and insulating materials in other embodiments. The thermal loop 14 is disposed along the side of the anisotropic composite 12, in direct contact with the edge of the conductive material 16. In other embodiments, the thermal loop 14 is disposed within a portion of the composite 12, between adjacent conductive materials, being entirely self-contained within the composite 12. In still other embodiments, one or more thermal loops 14 are disposed distal from the edges (as shown in FIG. 8), entirely within the interior of a panel 12. The thermal loop 14 operates as a heat sink when the building needs cooling and operates as a heat source when building needs heating. The thermal loop 14 extends along the long edge or the entire perimeter of the anisotropic composite 12.

In the current embodiment, the thermal loop 14 includes one or more copper pipes 20 circulating water 22 (depicted in box 14 in FIG. 1) at a dynamically controlled temperature. One pipe 20 is shown in FIG. 1, but a greater number of pipes 20 can be used if desired, for example one pipe 20 for each thermally conductive material (e.g., one copper pipe for each aluminum facing). When operating in a cooling mode, the water temperature within the thermal loop is regulated to be about 10° C. lower than the outdoor ambient temperature. When operating in a heating mode, the water temperature within the thermal loop is regulated to be about 10° C. greater than the outdoor ambient temperature. The same pipes 22 are used for both cooling and heating. In cooling operations, the thermal loop 14 runs water at 10° C. less than the outdoor ambient temperature until the outdoor air temperature is 12.78° C. (55° F.), and thereafter turns off. Below this building balance point temperature, the thermal loop 14 is optionally switched to a heat source 14 with temperatures 10° C. higher than outdoor temperatures. The thermal loop 14 is optionally operated in accordance with a closed feedback loop, in which a control action (e.g., control of thermal loop temperature) is determined by comparing a measured value (e.g., the temperature of the cooling fluid) with a reference value (e.g., outdoor ambient temperature minus a buffer, for example 10° C.). The resulting difference creates an error signal, which is used to raise or lower the temperature of the cooling fluid to maintain a temperature of approximately 10° C. below ambient. Though described above as circulating water, the thermal loop 14 can circulate other fluids (e.g., glycol, refrigerant) and temperature differences as desired. The thermal loop optionally uses Earth ground for regulating the temperature of the fluid 22. The outdoor ambient temperature measurements can be made periodically on an hourly basis, and as noted above, the building balance point temperature can be 55° F. or some other value as desired.

The thermal management system 10 is disposed between conventional building materials along an exterior of the building structure. As shown in FIG. 1 for example, a 0.25" stucco 24 is spaced apart from a wall structure comprising oriented strand board (OSB) 26, cavity insulation 28, wood studs 30, and drywall 32. Though shown as part of a wall structure, the thermal management system 10 can constitute part of roofs or ground floors. The components of the anisotropic composite 12 can be pre-bonded to each other as a single construction, or separately applied to the OSB 26. Alternatively, the thermal management system 10 can be disposed between conventional building materials along the interior of the building structure.

A method for installing the thermal management system 10 for new constructions or as a retrofit includes positioning the anisotropic composite 12 between a wall structure (or roof structure) and its exterior cladding 24. The anisotropic composite 12 comprises of alternating layers of an insulating material, for example polyisocyanurate foam, and a thermally conductive material, for example aluminum sheets. Three alternating layers of 0.5-inch-thick insulation boards and 0.04-inch-thick aluminum sheets are used at each wall section, but greater or fewer panels and panels of varying thicknesses can be used in other embodiments. Once secured to the wall structure, for example OSB 26 that is opposite cavity insulation 28, the method includes running a thermal loop 14 along the long edge or the entire perimeter of the composite 12. The method then includes applying the outer cladding to the outermost layer of the composite 12. The method further includes operating the thermal loop 14 in a cooling mode to maintain its temperature lower than the outdoor ambient temperature or operating the thermal loop 14 in a heating mode to maintain it at greater than the outdoor ambient temperature. In some operations, the thermal loop 14 turns off. Below a building balance point temperature, the thermal loop can be switched to a heat source with temperatures 10 C higher than outdoor temperatures.

Example 1

Figure 2:
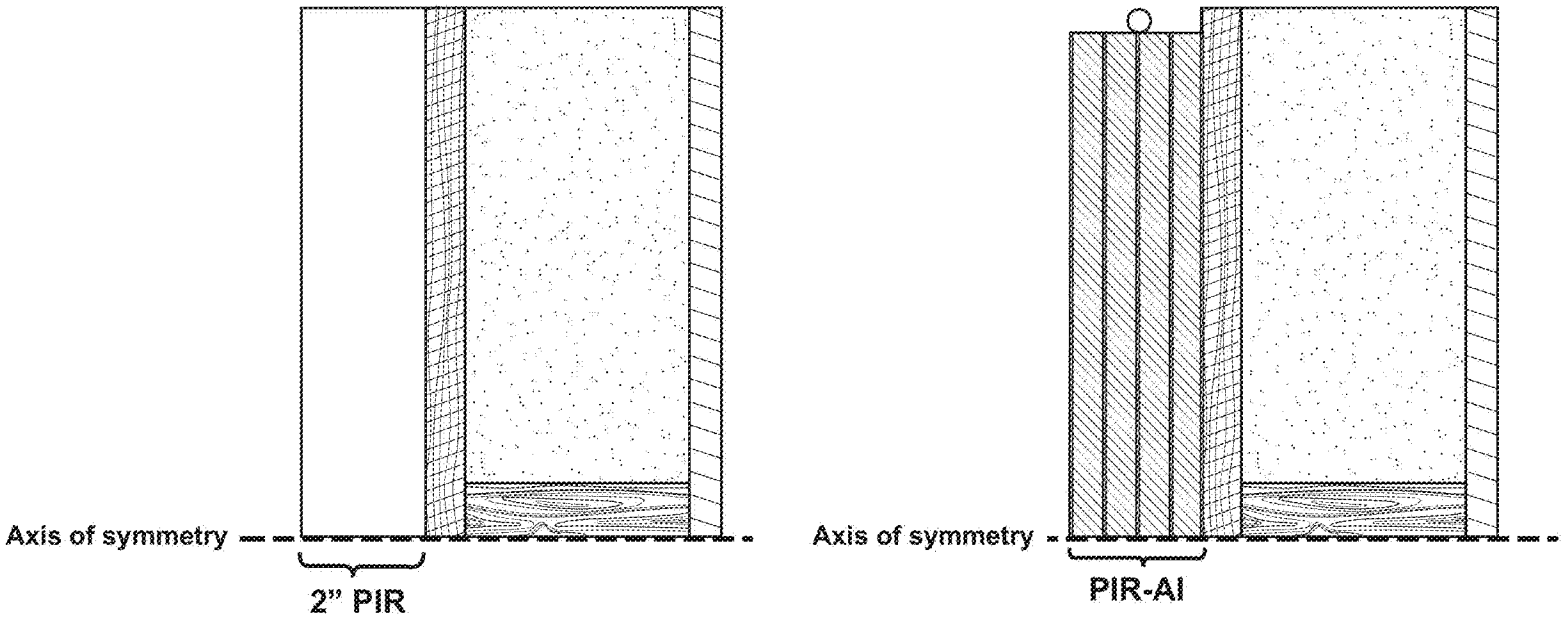
FIG. 2 is a schematic representation of two modeled geometries for evaluating the thermal performance of embodiments of the present invention. The left diagram shows the baseline, which consists of a 2×4 wood-stud wall with 2 inch-thick polyisocyanurate insulation. The right diagram shows a 2×4 wood-stud wall with the thermally anisotropic composite (i.e., alternating layers of 0.5 inch-thick polyisocyanurate insulation and 0.04-inch-thick aluminum sheets) and a thermal loop.
Figure 3:
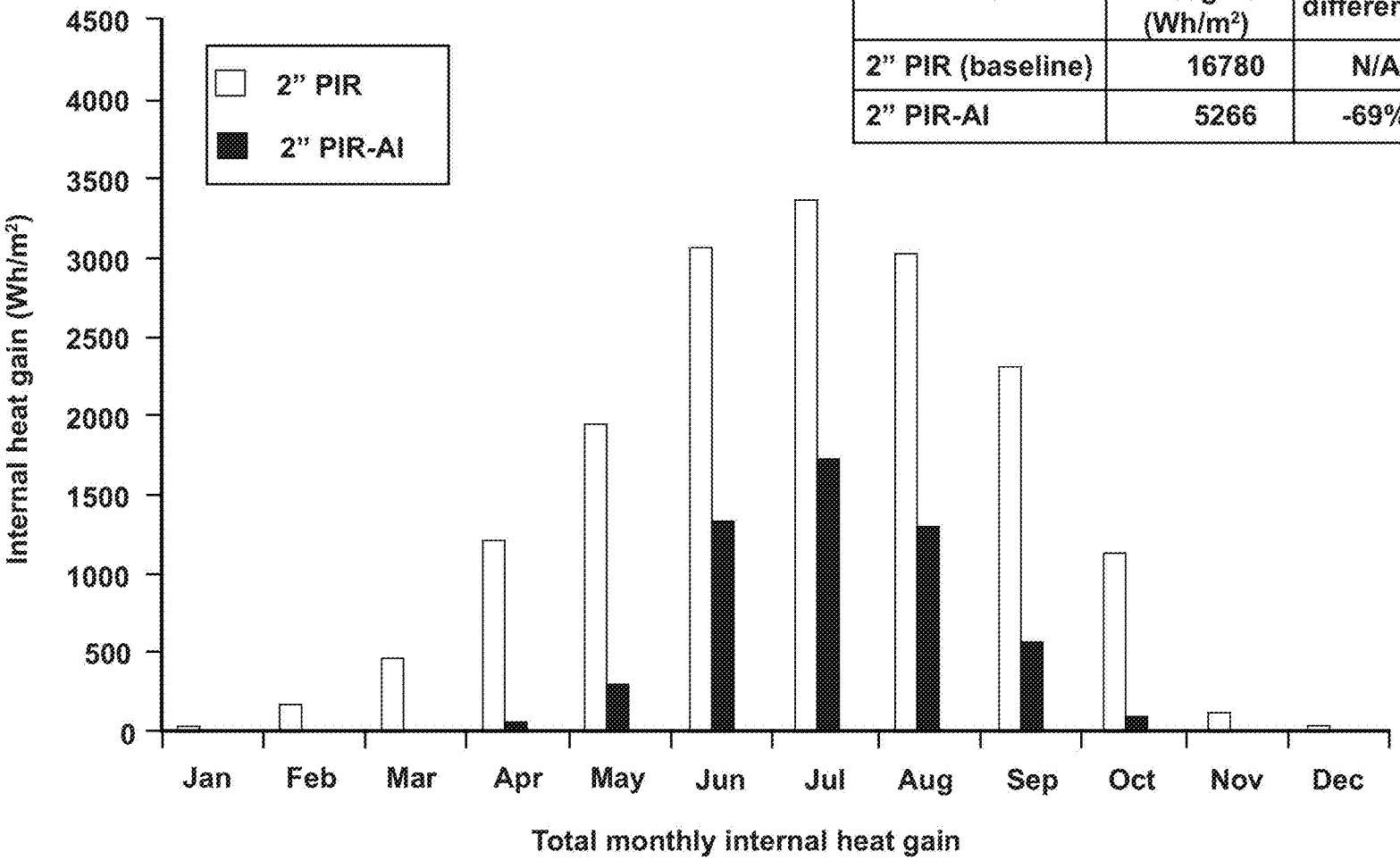
FIG. 3 is a graph illustrating simulation results of wall-generated cooling loads for an embodiment of the present invention as compared with polyisocyanurate insulation, both of which are shown in FIG. 2.
Figure 4:
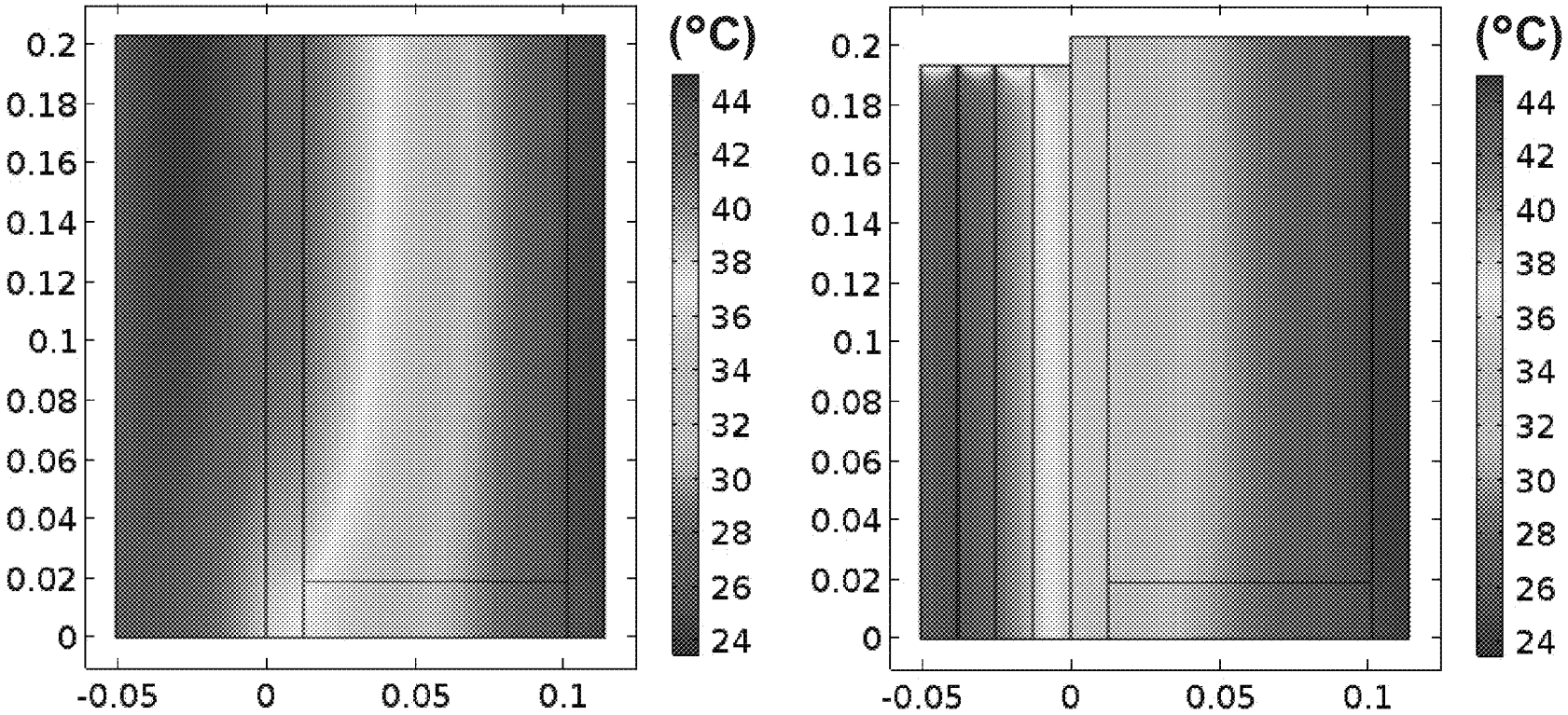
FIG. 4 is a color plot illustrating simulation results of the heat transfer through the wall layouts shown in FIG. 2.

Two geometries were constructed for modeling wall-generated cooling modes. As shown in FIG. 2 (left to right), the baseline geometry included 2" polyisocyanurate foam (PIR) board ($k_{PIR}$=0.024 W/m·K) with no conductive materials and no thermal loop. The second geometry included four 0.5" PIR boards (2" in total) with alternating 0.04" aluminum (Al) sheets ($k_{PIR}$=0.024 W/m-K, $k_{Al}$=283 W/m·K) and a thermal loop. The simulation assumed a west-facing wall using Phoenix, Arizona, weather data, and the thermal loop was assumed to have a temperature lower than the outdoor temperature by 10° C. The room temperature was allowed to float between assumed heating and cooling set points (20-23.3° C. or 69-74° F.). Internal heat gains and losses were calculated at the interior surface of the wall. As shown in FIG. 3, calculated cooling loads were reduced by 69% with the PIR-Al composite as compared to the baseline 2" PR. As shown in FIG. 4, summertime calculations show discernable differences in the depth of heat penetration from an exterior surface for the first (baseline) geometry and the present invention.

Example 2

Figure 5:
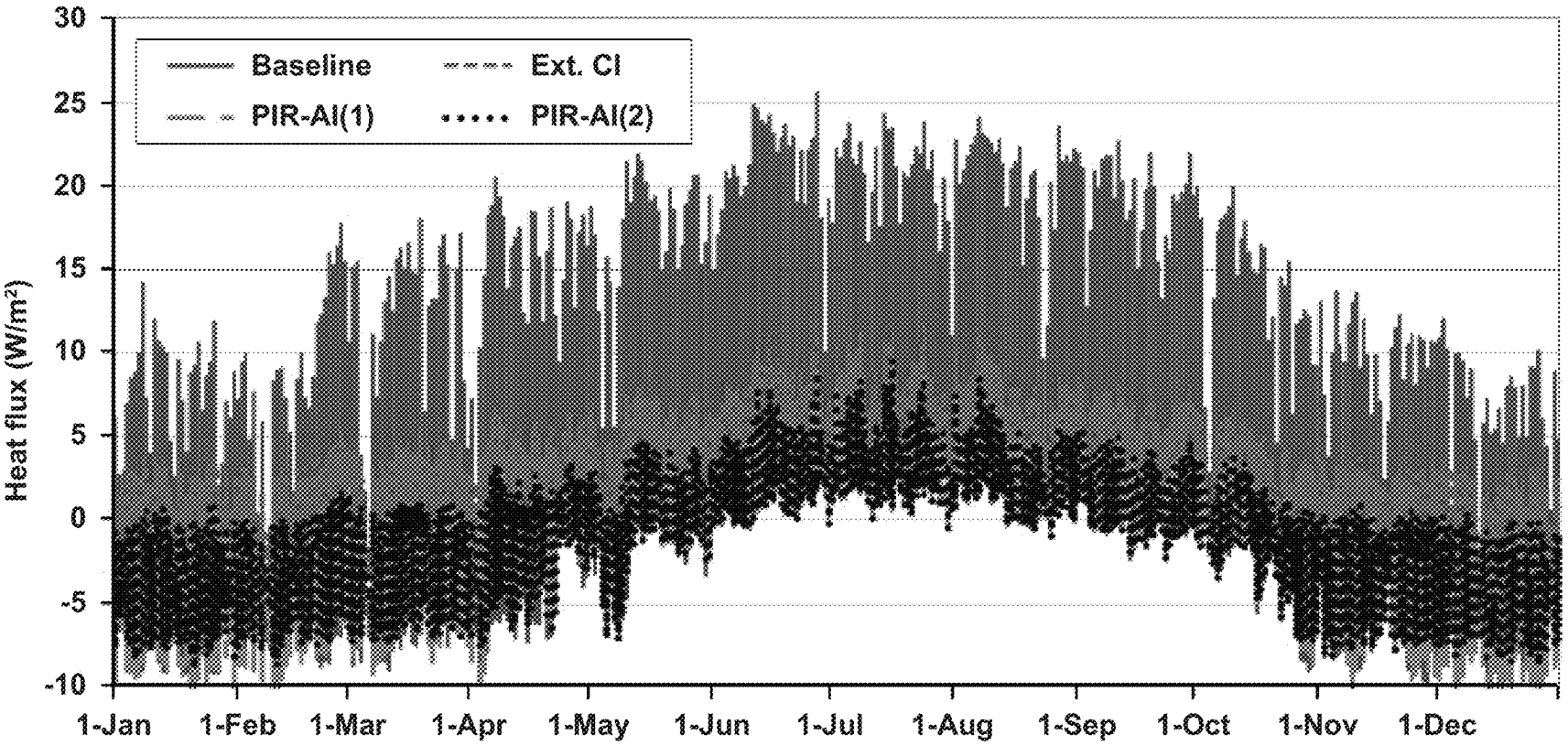
FIG. 5 is a comparison of the calculated hourly heat fluxes for an exterior west-facing wall having various thermal management systems with Phoenix, AZ, weather conditions.
Figure 6:
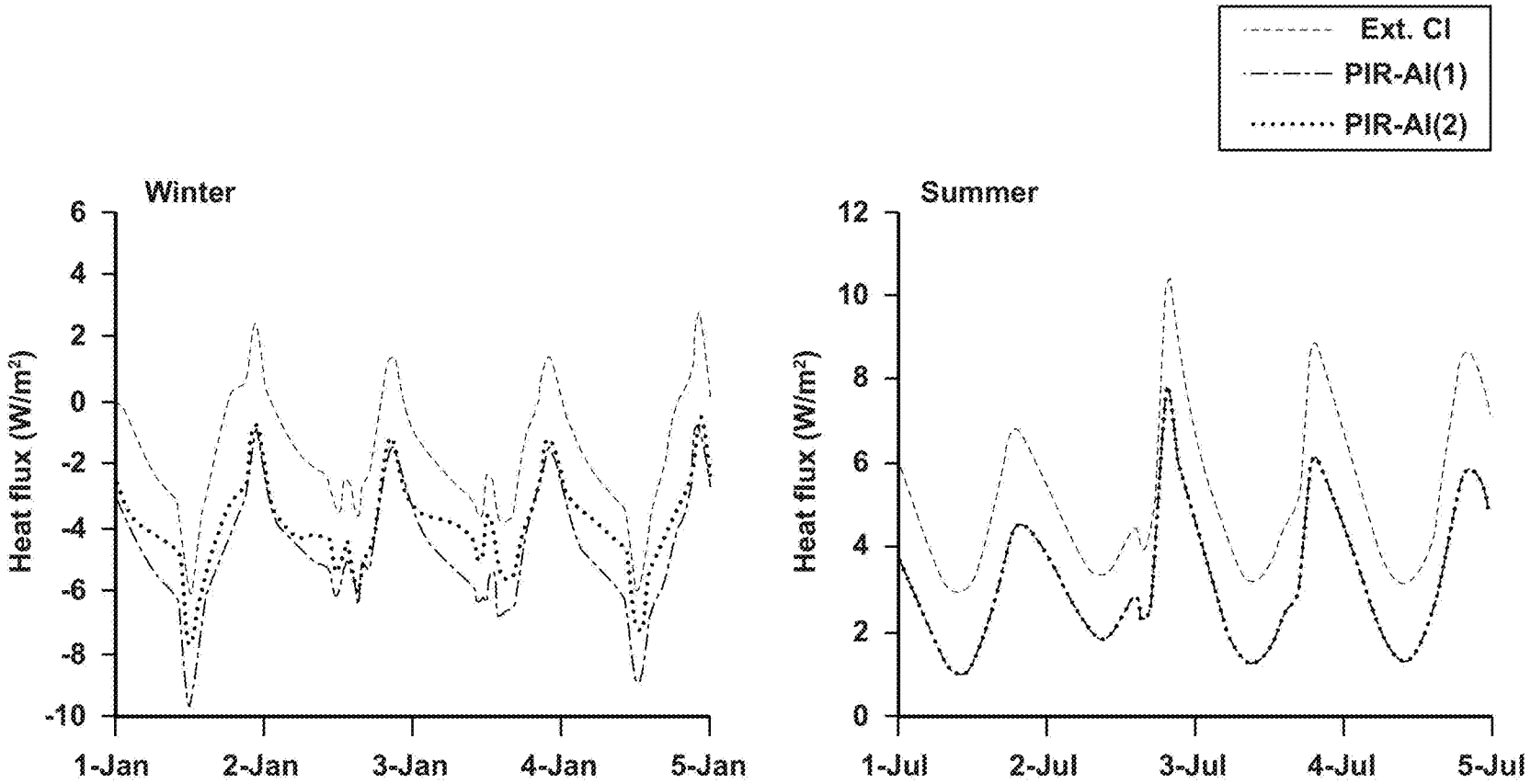
FIG. 6 are comparisons of calculated heat fluxes for an exterior west-facing wall for short time periods during winter months and summer months with Phoenix, AZ, weather conditions.
Figure 7:
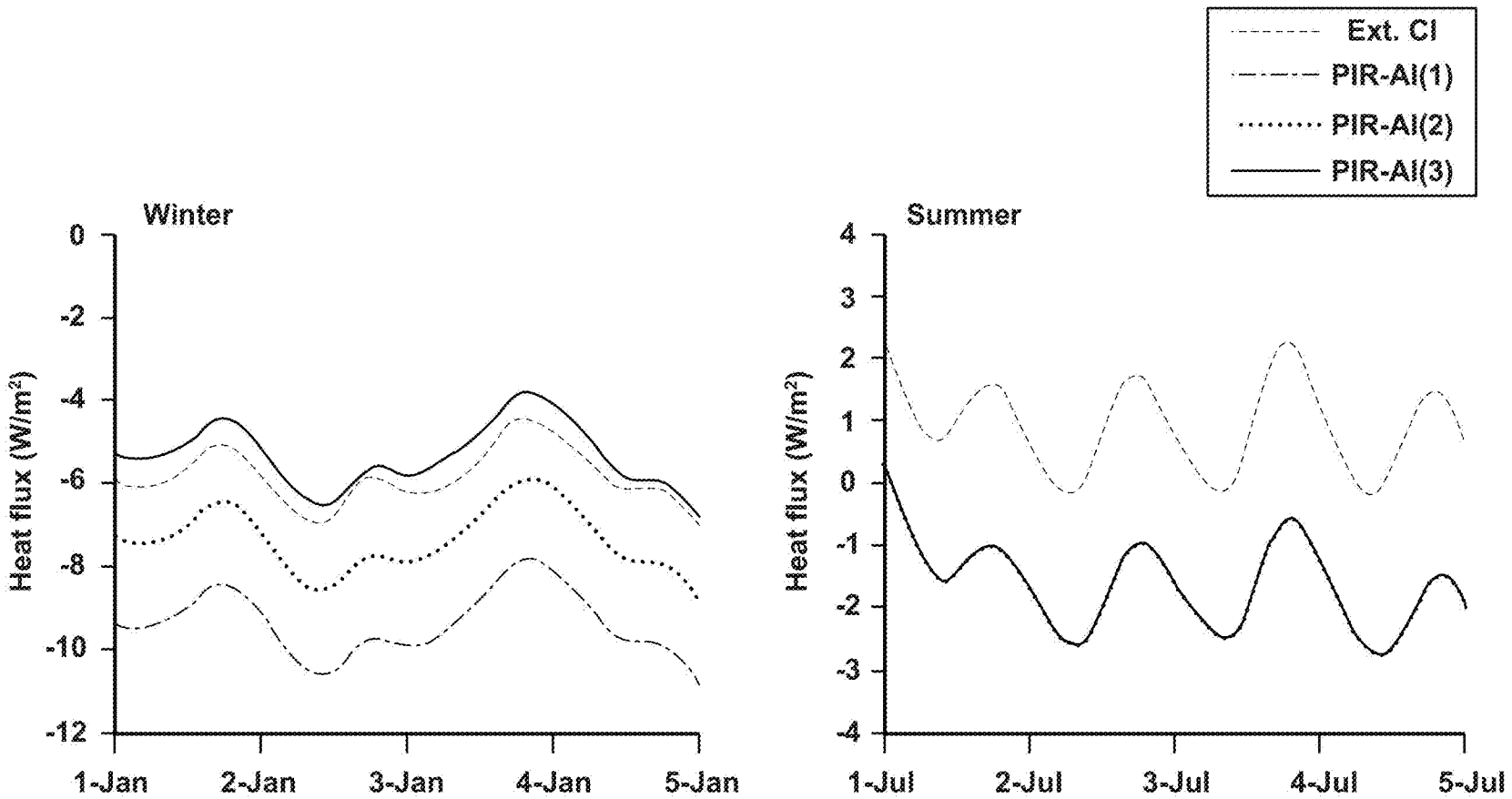
FIG. 7 are comparisons of calculated heat fluxes for an exterior north-facing wall for short time periods during winter months and summer months with Baltimore, MD, weather conditions.

In this example, the thermal performance of the following systems were evaluated: (a) 0.25" stucco over 0.5" sheathing ("baseline"); (b) 0.25" stucco over 1.5" continuous insulation PIR board ("CI"); (c) 0.25" stucco over three alternating layers of 0.5" PIR panels and 0.04" aluminum sheets and a heat sink of 10° C. below ambient ("PIR-Al(1)"); (d) and 0.25" stucco over three alternating layers of 0.5" PIR and 0.04" aluminum sheets and a heat sink of 10° C. below ambient but turned off below 12.78° C. (55° F.) ("PIR-Al (2)"). These materials were assumed to extend over 0.625" OSB, 3.5" cavity insulation, and 0.5" drywall. FIG. 5 compares the calculated heat flux (W/m$^2$) on an hourly basis from annual simulations for a west-facing wall using Phoenix, Arizona, weather data. The differences in peak heat gains are readily observable. For FIG. 6, the same results are plotted for CI, PIR-Al(1), and PIR-Al(2) for shorter time periods during winter and summer. Both PIR-Al(1) and PIR-Al(2) geometries showed reduced peak summer heat gains compared to CI. During winter modeling, the PIR-Al (2) geometry showed lower peak heat losses compared to PIR-Al(1). Similar reductions in calculated peak gains during summer months were observed in simulation results using weather conditions from Baltimore, Maryland FIG. 7 shows the calculated heat fluxes through a north-facing wall in Baltimore during winter and summer periods. Of note, for PIR-Al(3), the heat sink temperature was 10° C. lower than outdoor temperatures when the outdoor temperature was higher than 12.78° C. Below this building balance point temperature, the heat sink was switched to a heat source with temperatures 10° C. higher than outdoor temperatures. All PIR-Al geometries showed a similar reduction in summertime peak heat games compared to the CI geometry. The simulation results show that with a suitable thermal loop, significant reductions in both heating and cooling loads can be obtained compared to the baseline scenario and even the CI geometry.

Example 3

In this example, the net heat transfer through a thermal anisotropic composite ("TAC"), discussed below, was measured by the net heating or cooling power ($Q_{meter}$) needed to maintain a meter chamber at or near the "room" temperature of 23.9° C. This example was performed in a large-scale climate simulator (LSCS) consisting of three chambers: climate, meter, and guard. The climate chamber was above ground and simulates outdoor weather conditions, the meter and guard chambers were below ground and simulated indoor temperature and humidity. The meter chamber was surrounded on five sides by the guard chamber except for the side facing up, which is exposed to the test specimen. During testing, the edge of the meter chamber is sealed against the indoor side of the wall assembly and provides a measurement of the total heat flow through the 2.44 m×2.44 m central measurement area of the test specimen. The LSCS serves as a guarded hot box apparatus and testing was performed in according with ASTM C1363. A positive $Q_{meter}$ indicates net heat flow from the climate chamber to the meter chamber (heat gain) or a cooling load, while negative $Q_{meter}$ indicates heat loss from the meter chamber or a heating load.

Figure 9:
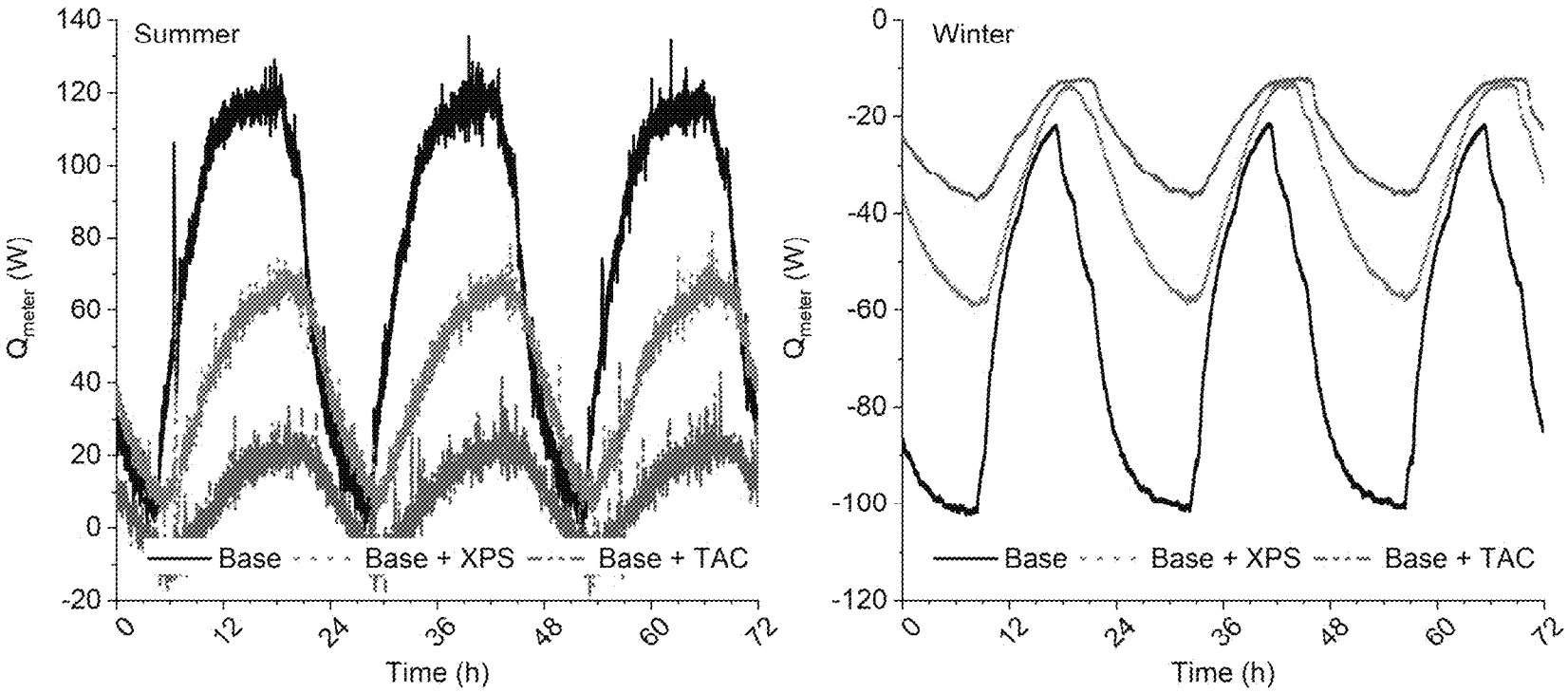
FIG. 9 are graphs showing measured heat gains and heat losses through the 2.44 m×2.44 m central measurement area of the test specimen of FIG. 8.

The TAC is shown in FIG. 8, consisting of three alternating layers of 1.3 cm thick XPS boards and 0.13 mm thick Al foil for a total of six layers, with copper (Cu) conduits (12.7 mm OD, 10.9 mm ID) installed next to alternating wall cavities within the intermediate XPS boards. FIG. 9 shows the effectiveness of the TAC connected to thermal loop in reducing both cooling and heating loads compared to the two baseline walls. The baseline or "Base" wall was built with wood studs of 3.8 cm width and 8.9 cm depth that were spaced 0.4 m apart. The wall cavities, i.e., the spaces between the wood studs, were filled with fiberglass insulation and were covered by 1.3 cm thick oriented strand board (OSB) and gypsum board as exterior and interior sheathings, respectively. Next, the baseline wall was upgraded by adding three layers of 1.3 cm thick XPS as exterior insulation to create the "Base+XPS" test wall. Finally, a third test wall ("Base+TAC") was created by adding the TAC and Cu tubes to the baseline wall. Under summer conditions, the peak cooling loads were reduced by 43.4% with the "Base+XPS" wall and by 79.5% with the "Base+TAC" wall compared to the "Base" wall. Under winter conditions, the reductions in peak heating loads were 42.1% and 63.7% with the "Base+XPS" and "Base+TAC" walls, respectively. FIG. 10 compares the integrated cooling and heating loads over 72-hour summer and winter periods and the percent reductions in the loads with the addition of XPS only and the TAC+thermal loop to the baseline wall. The results showed that thermal anisotropic composite connected with a thermal loop can significantly outperform insulation materials of similar thickness. Under summer conditions, "Base+TAC" doubled the decrease in cooling loads compared to "Base+XPS." Under winter conditions, "Base+TAC" increased the reduction in heating loads by 40% compared to "Base+XPS."

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A thermal management system for a structure comprising:

an anisotropic composite that consists of alternating layers of an insulating material and a thermally conductive material, wherein the insulating material includes a foam board and wherein the thermally conductive material includes a metal sheet that is coextensive in surface area with the foam board, such that the metal sheet is disposed between and directly contacts two foam boards, wherein the metal sheet of the anisotropic composite includes a peripheral edge;

a thermal loop comprising a fluid moving through a conduit, the conduit extending parallel to the peripheral edge of the metal sheet in direct contact with the metal sheet, the fluid moving through the conduit having a dynamically controlled temperature that is lower than an outdoor ambient temperature during a cooling season and that is higher than an outdoor ambient temperature during a heating season, the temperature of the fluid being controlled in relation to each such outdoor ambient temperature in accordance with a closed feedback loop; and an inner wall structure that is inwardly adjacent to the anisotropic composite and an outer wall structure that is outwardly adjacent to the anisotropic composite, wherein an uppermost extent of the anisotropic composite is recessed relative to an uppermost extent of each of the inner wall structure and the outer wall structure to define a vertical recess between the inner wall structure and the outer wall structure, the conduit being disposed within the vertical recess, the anisotropic composite being disposed vertically and against the inner wall structure and against the outer wall structure, wherein the anisotropic composite has an in-plane thermal conductivity that is greater than a through-plane thermal conductivity to reduce heat transfer to the inner wall structure.

2. The thermal management system of claim 1 wherein the metal sheet includes aluminum having a thickness of between 5 microns and 500 microns, inclusive.

3. The thermal management system of claim 1 wherein the foam board includes polyisocyanurate foam with a thickness of between 0.25 inches and 7 inches, inclusive.

4. The thermal management system of claim 1 wherein the conduit includes a copper pipe circulating water at the dynamically controlled temperature.

5. The thermal management system of claim 4 wherein the conduit stops circulating water when the outdoor ambient temperature lowers below a building balance point temperature.

6. The thermal management system of claim 4 wherein the conduit circulates heated water when the outdoor ambient temperature is below a building balance point temperature.

7. A thermal management system comprising:

an anisotropic composite that consists of alternating layers of polyisocyanurate foam boards and aluminum sheets, wherein the aluminum sheets are coextensive in area with the polyisocyanurate foam boards, such that each of the aluminum sheets is disposed between and directly contacts two foam boards, wherein each of the aluminum sheets of the anisotropic composite includes a peripheral edge; and a thermal loop comprising a fluid moving through a conduit, the conduit extending parallel to and in direct contact with the peripheral edge of at least one of the aluminum sheets of the anisotropic composite, the fluid moving through the conduit having a dynamically controlled temperature that is less than ambient in a cooling season and greater than ambient in a heating season, the temperature of the fluid being controlled in relation to each such ambient temperature in accordance with a closed feedback loop, an inner wall structure that is inwardly adjacent to the anisotropic composite and an outer wall structure that is outwardly adjacent to the anisotropic composite, wherein an uppermost extent of the anisotropic composite is recessed relative to an uppermost extent of each of the inner wall structure and the outer wall structure to define a vertical recess between the inner wall structure and the outer wall structure, the conduit being disposed within the vertical recess, the anisotropic composite being disposed vertically and against the inner wall structure and against the outer wall structure, wherein the anisotropic composite has an in-plane thermal conductivity that is greater than a through-plane thermal conductivity.

8. The thermal management system of claim 7 wherein the aluminum sheets include a thickness of between 5 microns and 500 microns, inclusive.

9. The thermal management system of claim 7 wherein the polyisocyanurate foam boards include a thickness of between 0.25 inches and 7 inches, inclusive.

10. The thermal management system of claim 7 wherein the anisotropic composite includes at least three polyisocyanurate boards each having a thickness of not more than 0.75 inches.

11. The thermal management system of claim 7 wherein the conduit includes a copper pipe and wherein the moving fluid includes water.

12. The thermal management system of claim 7 wherein the water is maintained at below the outdoor ambient temperature during the cooling season.

13. The thermal management system of claim 7 wherein the water is maintained at above the outdoor ambient temperature during the heating season.

* * * * *